United States Patent [19]

Rydborn

[11] Patent Number: 4,628,847

[45] Date of Patent: Dec. 16, 1986

[54] APPARATUS FOR THREAD MONITORING

[76] Inventor: Åke Rydborn, Klöxhultsvägen 21, 343 00 Elmhult, Sweden

[21] Appl. No.: 492,913

[22] Filed: May 9, 1983

[30] Foreign Application Priority Data

May 17, 1982 [SE] Sweden ..... 8203077

[51] Int. Cl.[4] ..... D05B 69/36

[52] U.S. Cl. ..... 112/273

[58] Field of Search ..... 112/273, 278, 275; 66/163; 139/353; 310/330, 338, 340, 345

[56] References Cited

U.S. PATENT DOCUMENTS

| | | | |
|---|---|---|---|
| 3,377,439 | 4/1968 | Rouy | 310/330 X |
| 4,170,951 | 10/1979 | Dobrjanskyj | 112/278 |
| 4,361,777 | 11/1982 | Mettler | 310/330 |
| 4,429,651 | 2/1984 | Tajima | 112/273 |
| 4,558,654 | 12/1985 | Schilling | 112/273 X |

FOREIGN PATENT DOCUMENTS 3029782 2/1981 Fed. Rep. of Germany .

*Primary Examiner*—Peter Nerbun

*Attorney, Agent, or Firm*—Beveridge, DeGrandi and Weilacher

[57] ABSTRACT

An apparatus for monitoring the underthread in sewing machines, in which at least one signal generator is mounted in the path of the underthread and is disposed to generate an electric signal when the underthread is urged by means of a looper against the signal generator, and the generated signal is coupled to a signal monitoring circuit electrically connected to the signal generator device and is operable to shutdown the machine in response to a loss of said signals from said signal generator device.

2 Claims, 12 Drawing Figures

27
21
20
23
24
25
26

VIII
21
20
23
22
VIII 33
31
32
35
30
35
36
34
36

1M
1k
1.5μ
0.01μ
0.01μ
IN4148
CONTROL
AND SENSITIVITY
B
100k
14
10k
Cl
Q1
5
1k
A
2
7
6
1
D
Q2
4
STOP
3
4
LF356
47p
Q3
6
2×IN4148
4018
10M
IN4148
10
10
100M
+12V
1.5μ
PXE
0V

A
0.
B
0

APPARATUS FOR THREAD MONITORING

TECHNICAL FIELD

The present invention relates to an apparatus for monitoring the underthread in sewing machines.

THE STATE OF THE ART

There are many known types of thread sensors which are specially adapted to looms of different constructions. As a result, these prior art thread sensors have relatively restricted fields of use and seldom can be used for monitoring a thread in machines other than looms.

TECHNICAL PROBLEM

The task forming the basis of the present invention is to realize a thread guard and monitoring apparatus for sewing machines and,in particuluar, for monitoring the underthread.

SOLUTION

The task forming the basis of the present invention is solved in that at one signal generator is mounted in the path of the underthread and is operative to generate a signal when the underthread is urged by means of a looper against the signal generator and that the generated signal is coupled to a signal monitoring circuit which is operative to generate a signal for shutting down the machine in dependence upon the desired number of signal losses and possibly indication by the signal generator indicating signal loss. Preferably,the signal generator consists of a piezoelectric rod whose one end is fixedly retained in a bracket and whose other end is connected to a second rod of, for example, ceramic material which is movably disposed in a bracket by means of bushings of resiliently yieldable material, for example, rubber, whereby abutment of the underthread against the second rod entails deflection of the piezoelectric rod which thereby generates an electric signal. The signal monitoring circuit appropriately includes means for converting the signal from the signal generator into a break in a signal level in dependence upon a synchronization pulse generated during each stitch. A flag circuit is provided to generate the synchronization pulse in one regulation level, the length of the pulse corresponding to a sensing period during each stitch and the height of the pulse corresponding to the sensitivity of the signal monitoring circuit to the signal from the signal generator. The flag circuit further comprises means for generating a reset pulse in the regulation level the reset pulse being counter-directed to the synchronization pulse. The signal monitoring circuit further includes means for generating a stop signal machine in the event of absence of signal from the signal generator, in dependence of a synchronisation pluse generated during each stitch and possibly a pulse which corresponds to a certain number of stiches without requirement of a signal from the signal generator. The signal generator and its signal monitoring circuit are connected to a circuit for evaluation of the signal from the monitoring circuit in such a way that the absence of signal break during one or more synchronization pulses entails shutdown of the machine and, it the event that the machine is provided with several signal generators and signal monitoring circuits, these are connected in parallel to the evaluation circuit.

ADVANTAGES

Employing an apparatus according to the invention, it is possible, with a great degree of accuracy, to monitor the underthread in a sewing machine in that the underthread must be urged against the signal generator by a certain force in order that the generator emit a signal of sufficient strength to prevent the signal monitoring circuit and associated circuits from generating a shutdown signal for stopping the machine. An apparatus according to the present invention is, thus, relatively insensitive to the extreme environment which prevails in a sewing machine, consisting of considerable vibration, varying working speed of the machine, varying thread quality, varying thread tensioning, and so on. With an apparatus according to the present invention, it is moreover, a simple matter to set, through a central operating panel, the desired sensitivity and such factors as the number of stitches during which signal loss is permitted from the signal gnerator without shutdown or stopping of the mahcine. Furthermore, an apparatus according to the present invention can be coupled in parallel and, after certain modifications, coupled in series with other similar units for monitoring a great number of signal generators.

DESCRIPTION OF THE ACCOMPANYING DRAWINGS

Figure 1:
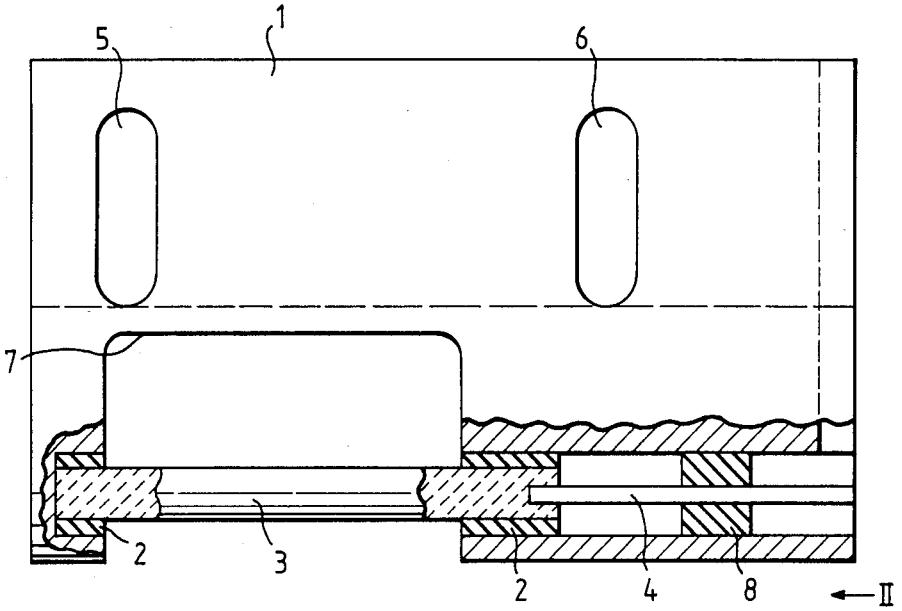
FIG. 1 is a top plan view of one embodiment of a signal generator according to the present invention, certain parts being in section for purposes of clarification thereof.
Figure 2:
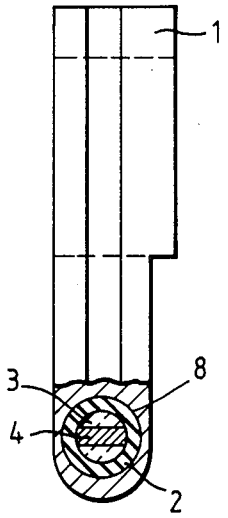
FIG. 2 is a view taken in the direction of the arrow II in FIG. 1, certain parts being prsented in section for purposes of clarification thereof.

Embodiments of the present invention will be described in greater detail below with reference to the accompanying Drawings. In FIG. 1 and 2, there is illustrated an embodiment of a signal generator according to the present invention. It should, at this juncture,be observed that the Drawings FIGS. 1 and 2 show the signal generator on a sacle of 4:1. The signal generator has a housing 1 of, for example, aluminum. The housing 1 may be provided with two elongate holes 5 and 6 for mounting the signal generator at a suitable position in the proximity of the underthread of a sewing machine. Furthermore, the housing 1 has a rectangular recess 7 through which a rod 3 of preferably ceramic material extends. The rod 3 of ceramic material is mounted in the housing by means of bushings 2 of resiliently yieldable material, for example rubber. The rod 3 is thus movable in the rectangular recess 7. A further rod 4 of piezoelectric material is fixedly retained in one end of the rod 3. This rod 4 is also designated piezoelectric crystal and in the present case it is particularly appropriate if the crystal is of the so called multimorph type, which entails that the piezoelectric crystal is highly sensitive to bending stresses.

As is most clearly apparent from FIG. 2, the rod 4 is of rectangular cross-section, whereas the rod 3 is cylindrical. The opposite end of the rod 4 in relation to the rod 3 is fixedly anchored in the housing 1, a portion of the rod 4 being surrounded by a bushing 8 of resiliently yieldable material, for example rubber.

On urging of the rod 3 in an inward direction in the recess 7, the rod 4 will obviously be bent and thereby give rise to, or generate, an electric signal whose strengh is dependent upon the degree of bending. Naturally, the rod 4 is provided with an electric connection in a per se known manner for transmitting the generated signal to a suitable electronic sensing or monitoring circuit.

The housing 1 may possibly be manufactured from suitably punched and recessed aluminium sheeting which is bent about the arrangement of the rods 3 and 4 with the bushings 2 and 8.

Figure 3:
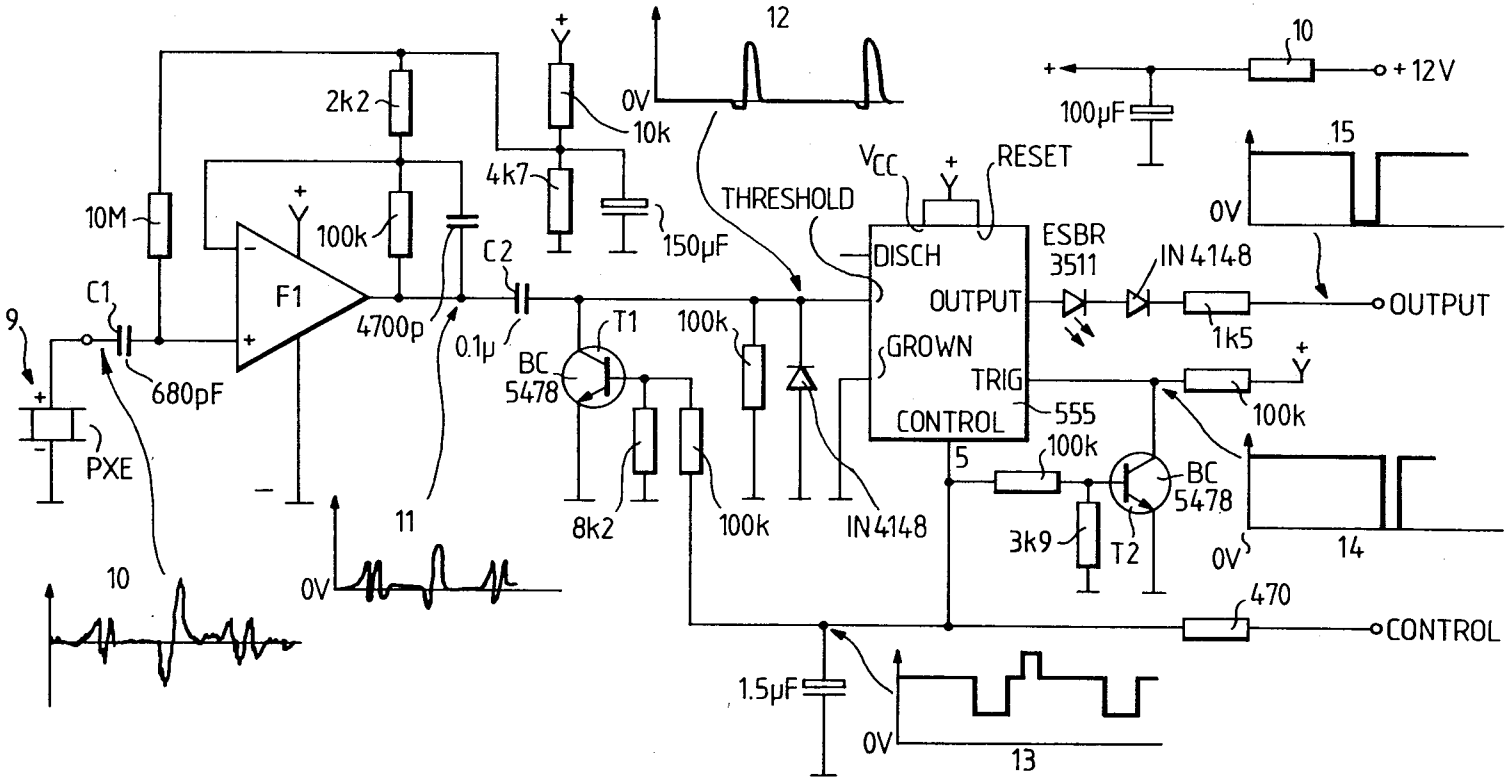
FIG. 3 is a coupling diagram of one embodiment of an apparatus according to the present invention, diagrams of pulses in the circuit being illustrated in the principal diagram and arrows indicated the point in the diagram where the pulse of signal occurs.

FIG. 3 illustrates and embodiment of section of a monitoring circuit according to the present invention. A signal generator 9 which may be of the type described above and shown and FIGS. 1 and 2, is coupled to an amplifier F1 by the intermediary of a capacitor C1. The amplifier is of the high-ohmic type and the amplification step includes a low pass filter for filtering off the high-frequency signal part overlaid on the signal generator 9. The high-frequency signal part occurs because of vibrations in the machine with the signal generator 9. At reference numeral 10, a pulse diagram is illustrated of the signal emanating from the signal generator 9, the arrow indicating that poiont in the circuit where the signal occurs. At reference numeral 11, a pulse diagram is shown of that signal which is obtained after amplification and filtering, the arrow leading to the point in the diagram where the signal occurs.

The amplified and filtered signal in the pulse diagram 11 is fed by the intermediary of a coupling capacitor C2 to a level-sensing 1C-circuit 555 via a swicth transistor T1 which allows the passage of the amplified and filtered signal from the signal generator 9 further to the circuit 555 only during pre-determined periods. In the pulse diagram 12, the signal is shown on the input to the circuit 555 and the arrow illustrates that point in the diagram where the pulses occur. The circuit 555 may be considered as a bistable flipflop which is switchable by means of the pulse in the signal 12 on condition that the pulse exceeds a predetermined threshold level. The pre-determined time period and threshold level are determined by means of a regulator signal from a central unit or monitoring circuit (not shown). Such a regulator signal is, however, shown on the pulse diagram at 13 and the arrow therefrom illustrates that point in the diagram where the signal occurs. The signals in the pulse diagrams 12 and 13 are fed to the circuit 555 whose inputs and outputs are coupled according to the diagram in FIG. 3. The pulse diagram 14 shows the trigger or reset signal to the circuit 555 generated by means of the transistor 12 and the regulator in the pulse diagram 13. The pulse diagram 15 shows the signal which is obtained on the output of the circuit 555 when an underthread has caused the signal generator 9 to generate a signal according to the pulse diagram 10 of sufficient amplitude to exceed the threshold level during the pre-determined time period which is determined the regulator signal in the pulse diagram 13.The regulator signal 13 consists, as will be apparent from the pulse diagram, of a signal level of a negative pulse which is generated by means of a so-called flag circuit whith a flag which is coupled to the machine in such manner that the synchronization pulse is during that point in time when underthread movement should occur. In the present case, the length of the synchronisation pulse is determinative of the time period during one stitch when the underthread is urged against the singal generator 9, whereas the amplitude of the pulse determines the signal level which is required of the signal from the signal generator 9 in order that the signal switches the circuit 555. The regulator signal according to the pulse diagram 13 includes a further pulse which is counter-directed to the synchronisation pulse and is positive in relation to the synchronization pulse. This further pulse is a reset pulse which resets the ouput level sensing circuit 555 from low to high.

The circuit illustrated in FIG. 3 is suitably coupled to a central unit which includes the above-described flag circuit for generating the regulator signal and a network system which may be connected to the points shown in the diagram. The central unit also comprises a section for evaluation of the output signal according to the pulse diagram 15 and may be operative to permit the absence of certain number of signal breaks before it generates a shutdown signal for shutting down the sewing machine. If the circuit generates one such shutdown signal,the illustrated LED designated ESBR3511 will light up, so that the operator may easily find that transducer which has given rise to the shutdown signal. With a certain number of missing signal breaks, it is intention that a certain number of stitches be permitted with the sewing machine with faulty underthread action against the signal emitter 9 before a shutdown of the machine will be necessary for correction purposes. A plurality of circuits according to FIG. 3 may be coupled in parallel to the same central unit.

Setting of the desired number of stitches can thus be effected in one central unit and also the appearance of the regulator signal illustrated in the pulse diagram 13, this signal determining both sensitivity and sensing time.

In the description of the diagram illustrated in FIG. 3, component details and the inerconnections of the different components have been omitted, since these details are obvious to the skiled reader of this specificaton.

In the event that it has not become apparent to the skilled reader of the foregoing, sensing of the pressure of the underthread against the ceramic rod 3 is effected but once per machine revolution or once during each stitch, which entails that the underthread is monitored or sensed only on those occasions when it is located alone between the looper and the stitch-plate in conventional sewing machines.It should here be observed that it is the looper which urges the underthread against the rod 3 to bend the rod 4.

Figure 4:
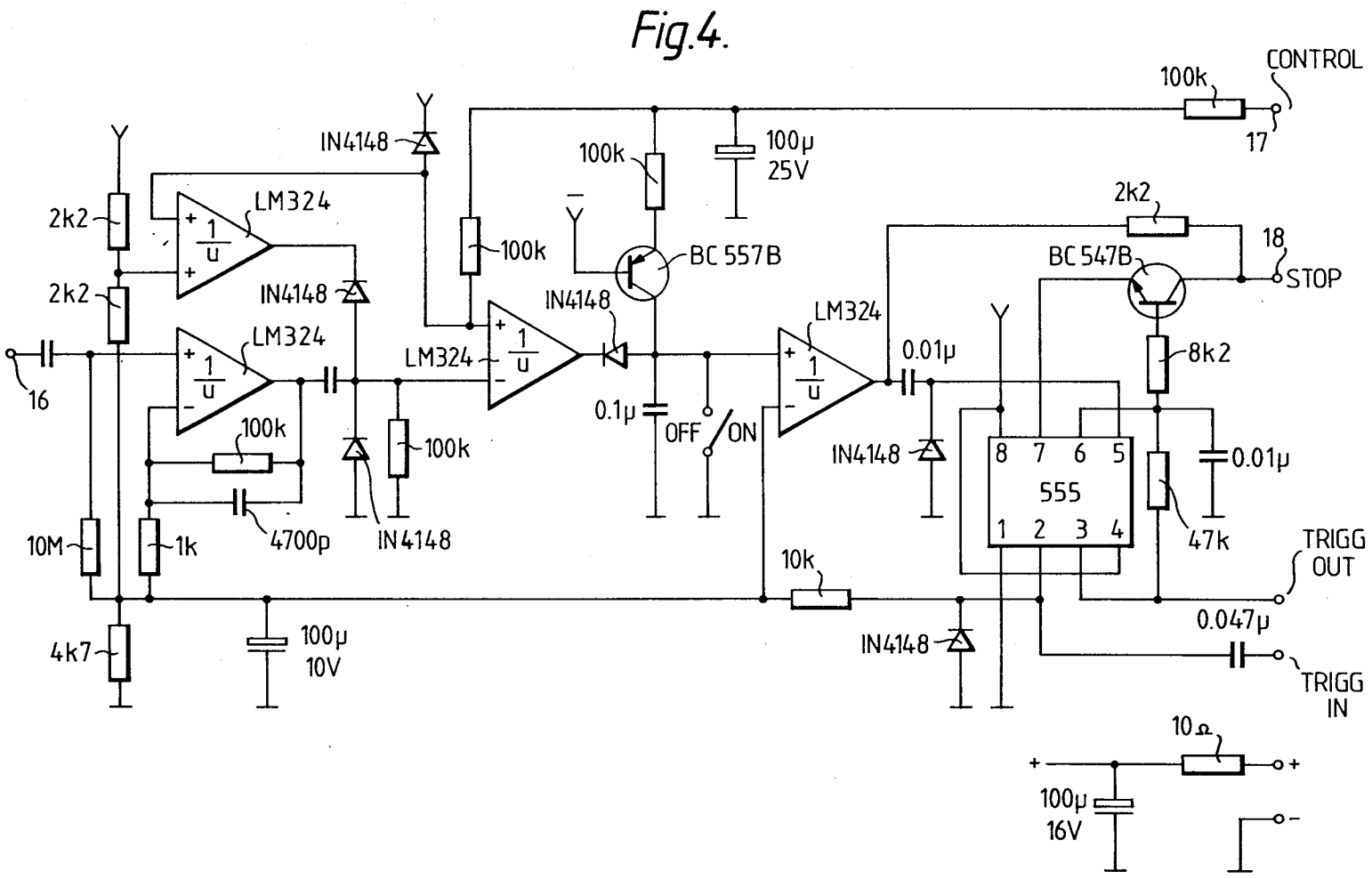
FIG. 4 is a coupling diagram of a further embodiment of an apparatus according to the present invention.
Figure 5:
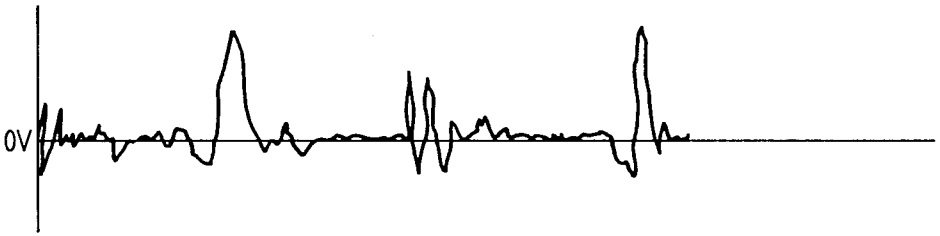
FIG. 5 shows a pulse diagram of a signal from a signal generator according to the present invention.
Figure 6:
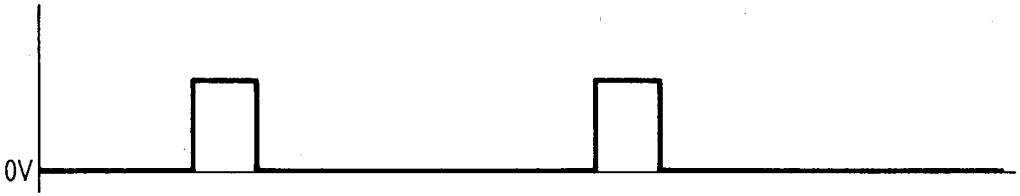
FIG. 6 illustrates a pulse diagram of a synchronisation pulse for the embodiment illustrated in FIG. 4.
Figure 7:
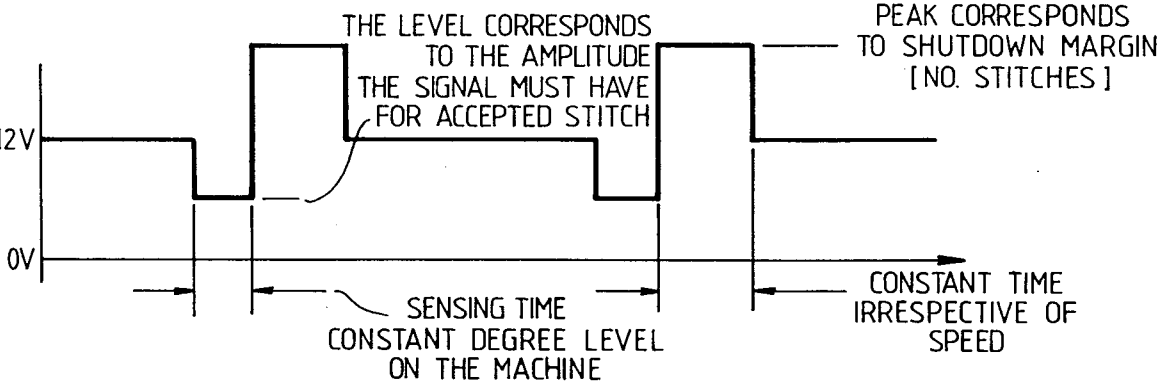
FIG. 7 shows a pulse diagram of a regulator signal for the embodiment of the present invention illustrated in FIG. 4.

FIG. 4 illustrates a further embodiment of an apparatus according to the present invention. A signal generator of the type illustrated in FIGS. 1 and 2 is connected to the input 16 and may advantageously be mounted on the underface of the stitch-plate in a position for actuating the rod by means of the underthread when the thread is moved into positoin by means of the looper. The signal from the signal generator 16 is illustrated in greater detail in FIG. 5 and this is fed to an amplifier and filter circuit and a comparator circuit whose one input is coupled by the intermediary of a resistor to a regulator signal input 17. The signal impressed on the input 17 is illustrated in greater detail in FIG. 7 and also in this embodiment the regulator signal of FIG. 7 is generated using a flag circuit which primarily generates a synchronization signal according to FIG. 6 and the pulse illustrated in FIG. 6 determines the time period during which possible underthread breakage may be sensed and which occurs at some suitable point in time during each stitch. The synchronization pulse in FIG. 6 is suitable generated by means of a flag which is coupled in a suitable manner to the machine. In the regulator signal according to FIG. 7, the synchronization pulse has its counterpart in a reduction of the level of the regulator signal to an extent which is determined by switches concerning the amplitude which the signal from the signal generator 16 must have in order that the underthread be considered to move in an acceptable manner. Hence, this entails that the amplitude corresponds to an accepted stitch. Immediately after the signal reduction, a considerable elevation takes place of the level of the regulator signal and this elevation corresponds to the number of stitches which may occur with one signal loss from the signal generator 16 before a shutdown signal is generated for shutdown of the machine. As is apparent from FIG. 4, this regulator signal according to FIG. 7 is fed to a comparator whose second input is impressed with the signal from the signal generator 16 and the output signal from the comparator is not fed further to the next comparator until the next criterium according to the regulator signal has been satisfied. As soon as the capacitor connected to the output of the comparator has been charged to a sufficient level in dependence upon the regulator signal and in the absence of output signal from the comparator, the subsequent comparator will give rise to a signal on its output which in turn entails a shutdown signal on the output 18.

Figure 8:
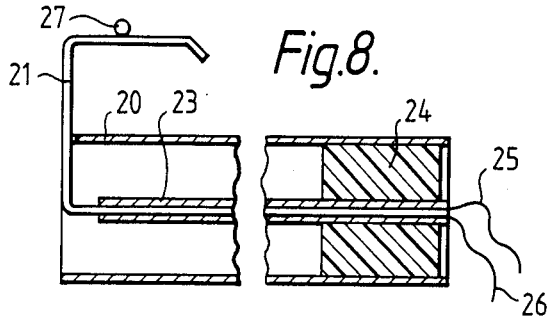
FIG. 8 is a section in the direction of the arrow VIII--VIIII in FIG. 9 of another embodiment of the present invention.
Figure 9:
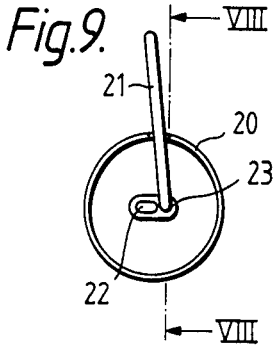
FIG. 9 is a view from the left in FIG. 8.

After the last-mentioned comparator, the embodiment illustrated in FIG. 4 is almost identical to the circuit described in FIG. 2 of Swedish Patent Application No. 8007254-9. In such an event, the central unit according to FIG. 3 of the above-mentioned Swedish Patent Application is also included, whereby it is very simple, after parallel-connection of a number of the circuits illustrated in FIG. 4, to esatblish which of the circuits gave rise to a shutdown signal. In FIGS. 8 and 9, there is illustrated an embodiment of a modified signal generator according to the present invention. This signal generator has a housing 20 in the form of a tube of, for example, brass. Inside the tube is a wire 21 of spring steel fixed at one end of the tube together with a long piezoelectric crystal 22 and a plastic tube 23 covering the wire 21 and the crystal 22 in a plastic means 24, for example, epoxy. The plastic tube 23 being crimped on the wire 21 and the crystal 22. The crystal 22 is glued on the wire 21 so that the crystal 22 will be bent together with the wire 21 when actuated by a thread. Due to the resilience of the wire and the spacing which exists between the crystal and the thread-contacting portion of the wire, the device inherently permits some relative movement between the crystal 22 and the thread-contacting portion of the wire 21. During bending the crystal 22 will generate a strong electric signal because the crystal 22 is very long in relation to its cross section. In the embodiment shown the crystal 22 has a length of 70 mm, a thickness of 0.5 mm and a width of 1.5 mm.

Figure 12:
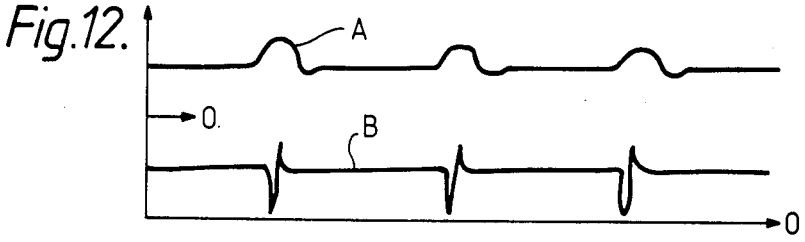
FIG. 12 shows a pulse diagram of a signal in the circuit according to FIG. 11.

One of the wires 25 and 256 is soldered to one side of the crystal 22 and the other 26 of the wires is soldered to the other side of the crystal 22. The crystal 22 is connected into the diagram in FIG. 12 as the component PXE and generates the signal A in FIG. 12 when it is bent by an underthread 27 via the wire 21. The signal A is of such level that it is not necessary to amplify the signal A which being fed directly to a comparator LF356. The signal B in FIG. 12 being fed to the other input of the comparator LF 356 and the signal B comprises a switch level of the comparator and a clock pulse for each stitch of the machine. The switch level is also the sensitivity of the circuit. The components 4018 is a well known circuit called Motorola MC14018B and is counted up by the signal from the comparator. If there is no thread-signal A during three successive clock pulses Q1–Q3 will be "1" and a shutdown signal is generated.

The signal A may be so strong that it is possible to cancel the comparator and feed the signal A from the crystal PXE directly to the shift register 4018.

Figure 10:
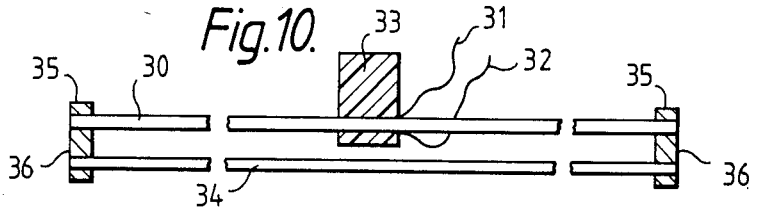
FIG. 10 is a view partly in section of a further embodiment of the present invention.
Figure 11:
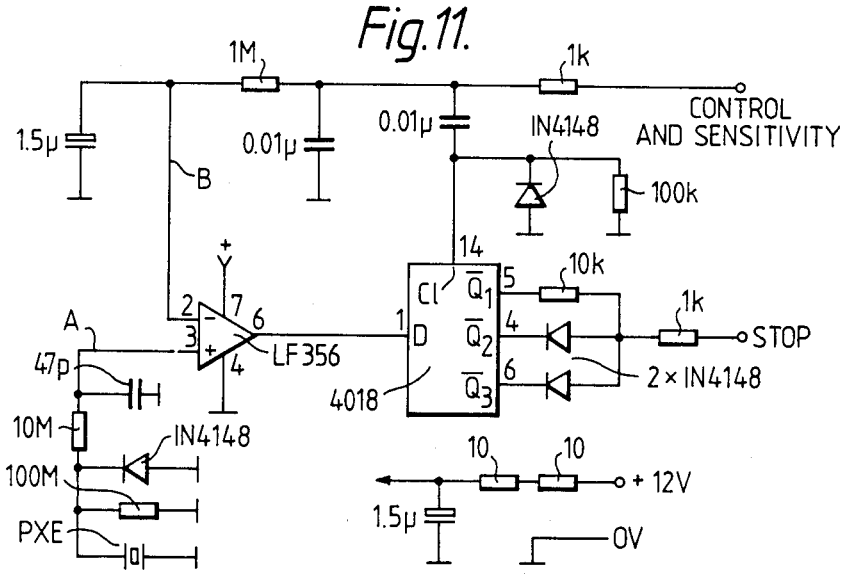
FIG. 11 is a coupling diagram of a further embodiment of the present invention.

FIG. 10 illustrates an embodiment provided for supervising or sensing several threads. The crystal 30 with the electrical wires 31 and 32 is fixed in a central plastic block so that the crystal 30 may be bent via a parallel ceramic rod 34. The rod 34 is fixed to the crystal 30 at the ends by a flexible ring 35 and a block 36 separating the parts. When actuated by a thread to be supervised the rod 34 will bend the crystal 30.A thread actuating the rod 34 anywhere between its ends with cause a bending of crystal 30 and generate a signal A. Several threads may be arranged side by side along the rod 34 and anyone of them may generate a signal from the crystal 30.

I claim:

1. An apparatus for monitoring the underthread in sewing machines, comprising, signal generator device which is mounted in the path of the underthread and is operative to generate electric signals when the underthread is urged against the signal generator device, a signal monitoring circuit which is electrically connected to the signal generator device and is operable to shutdown the machine in response to a loss of said signals from said signal generator device, said signal generator device having a resilient wire member with a movable portion which has a thread-contacting portion located in the path of the underthread so as to be contacted by the underthread during operation of the sewing machine, a piezoelectric rod connected to said resilient wire member and arranged to be bent in response to movement of said member by the underthread, said piezoelectric rod and said thread-contacting portion of the resilient wire member being spaced apart and being arranged so that some relative movement is permitted between the thread-contacting portion and the piezoelectric rod, said piezoelectric rod and said resilient wire member being elongated and having their longitudinal axes in mutually parallel relationship, and resilitent wire member having a section which is attached along its length to the piezoelectric rod so that said wire section and the piezoelectric rod will be bent together when the thread-contacting portion of the wire is actuated by a thread, said piezoelectric rod being operable to generate said electric signal when it is bent.

2. An apparatus according to claim wherein the resilient wire member is spaced from said piezoelectric rod.

* * * * *